US007356987B2

(12) United States Patent
Kiser et al.

(10) Patent No.: US 7,356,987 B2
(45) Date of Patent: Apr. 15, 2008

(54) EXHAUST GAS RECIRCULATION SYSTEM HAVING AN ELECTROSTATIC PRECIPITATOR

(75) Inventors: Matthew Thomas Kiser, Chillicothe, IL (US); David Michael Thaler, Mossville, IL (US); Anthony Clark Rodman, Chillicothe, IL (US); Matthew Earnest Williams, East Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 595 days.

(21) Appl. No.: 10/902,485

(22) Filed: Jul. 30, 2004

(65) Prior Publication Data

US 2006/0021327 A1 Feb. 2, 2006

(51) Int. Cl.
*F02M 25/06* (2006.01)

(52) U.S. Cl. ..... 60/278; 60/274; 60/275; 60/280; 60/289; 96/60; 96/65; 96/88

(58) Field of Classification Search ..... 60/274, 60/275, 278, 280, 289, 311; 96/60, 65, 83, 96/88; 123/568.11, 568.17
See application file for complete search history.

(56) References Cited

U.S. PATENT DOCUMENTS

| | | | | |
|---|---|---|---|---|
| 3,440,800 A | | 4/1969 | Messen-Jaschin | |
| 3,657,878 A | * | 4/1972 | Kaufmann, Jr. | 60/308 |
| 4,304,096 A | | 12/1981 | Liu et al. | |
| 4,380,900 A | | 4/1983 | Linder et al. | |
| 4,478,613 A | | 10/1984 | Brettschneider et al. | |
| 4,587,807 A | * | 5/1986 | Suzuki | 60/274 |
| 4,908,047 A | | 3/1990 | Leonard | |
| 4,969,328 A | | 11/1990 | Kammel | |
| 5,003,774 A | | 4/1991 | Leonard | |
| 5,097,665 A | | 3/1992 | Kammel | |
| 5,121,601 A | | 6/1992 | Kammel | |
| 5,121,734 A | * | 6/1992 | Grieshaber et al. | 123/568.17 |
| 5,546,747 A | * | 8/1996 | Colletta et al. | 60/275 |
| 5,557,923 A | | 9/1996 | Bolt et al. | |
| 5,950,424 A | | 9/1999 | Nojima | |
| 6,221,136 B1 | * | 4/2001 | Liu et al. | 96/66 |
| 6,364,941 B2 | | 4/2002 | Liu et al. | |

(Continued)

FOREIGN PATENT DOCUMENTS

WO WO 03/074184 9/2003

OTHER PUBLICATIONS

Wright, et al., "A Novel Electrostatic Method of Ultrafine PM Control Suitable for Low Exhaust Temperature Applications," SAE Technical Paper Series 2003-01-0771 Mar. 3-6, 2003, (11 pages).
Kittelson, et al., "Electrostatic Collection of Diesel Particles," SAE Paper 860009, pp. 19-30, 1986 (12 pages).

(Continued)

*Primary Examiner*—Tu M. Nguyen
(74) *Attorney, Agent, or Firm*—Finnegan, Henderson, Farabow, Garrett & Dunner

(57) ABSTRACT

An exhaust gas recirculation system for a power source, has at least one inlet port configured to receive at least a portion of a flow of exhaust produced by the power source. The exhaust gas recirculation system also has an electrode disposed upstream of the at least one inlet port and configured to charge particulate matter in the flow of exhaust. The exhaust gas recirculation system further has at least one collection surface configured to allow the at least one electrode to repel the charged particulate matter away from the at least one inlet port towards the at least one collection surface.

34 Claims, 1 Drawing Sheet

U.S. PATENT DOCUMENTS

| | | | | |
|---|---|---|---|---|
| 6,530,366 | B2 * | 3/2003 | Geiger et al. | 123/568.11 |
| 6,742,335 | B2 * | 6/2004 | Beck et al. | 60/605.2 |
| 6,902,604 | B2 * | 6/2005 | Heckel et al. | 96/80 |
| 7,131,263 | B1 * | 11/2006 | Styles | 60/278 |
| 7,267,711 | B2 * | 9/2007 | Liu | 96/21 |

OTHER PUBLICATIONS

Thimsen, et al., "The Performance of an Electrostatic Agglomerator as a Diesel Soot Emission Control Device," SAE Technical Paper Series 900330, Feb. 26-Mar. 2, 1990 (12 pages).

Ekchian et al., "A Compact Corona Discharge Device (CCD™) For Non-Thermal Plasma Generation in Gasoline or Diesel Engine Exhaust," Litex, Inc., 2000, (7 pages).

"Dry Electrostatic Precipitator (ESP)—Wire-Plate Type," EPA Document—EPA Air Pollution Control Fact Sheet EPA-452/F-03-208, http://www.epa.gov/ttn/catc/dir1/fdespwpi.pdf, pp. 1-6.

"Dry Electrostatic Precipitator (ESP)—Wire-Pipe Type," EPA Document—EPA Air Pollution Control Fact Sheet EPA-452/F-03-027, http://www.epa.gov/ttn/catc/dir1/fdespwi.pdf, pp. 1-5.

Turner, et al., "Particulate Matter Controls, Section 6, EPA/452/B-02-001," EPA Document—Particulate Matter Control, Section 6, http://www.epa/gov/ttn/catc/dir1/cs6ch3.pdf, (70 pages).

Hinds, William C., "Aerosol Technology, Properties, Behavior and Measurement of Airborne Particles," John Wiley & Sons, Inc., pp. 316-348 (1999).

* cited by examiner

EXHAUST GAS RECIRCULATION SYSTEM HAVING AN ELECTROSTATIC PRECIPITATOR

TECHNICAL FIELD

The present disclosure relates generally to an exhaust gas recirculation system and, more particularly, to an exhaust gas recirculation system having an electrostatic precipitator.

BACKGROUND

Internal combustion engines, including diesel engines, gasoline engines, natural gas engines, and other engines known in the art, may exhaust a complex mixture of air pollutants. The air pollutants may be composed of gaseous compounds, which may include nitrous oxides (NOx), and solid particulate matter, which may include unburned carbon particulates called soot.

Due to increased attention on the environment, exhaust emission standards have become more stringent. The amount of gaseous compounds emitted to the atmosphere from an engine may be regulated depending on the type of engine, size of engine, and/or class of engine. One method that has been implemented by engine manufacturers to comply with the regulation of these engine emissions has been to implement exhaust gas recirculation (EGR). EGR systems recirculate the exhaust gas by-products into the intake air supply of the internal combustion engine. The exhaust gas, which is redirected to the engine cylinder, reduces the concentration of oxygen therein, which in turn lowers the maximum combustion temperature within the cylinder. The lowered maximum combustion temperature slows the chemical reaction of the combustion process, thereby decreasing the formation of nitrous oxides.

In many EGR applications, the exhaust gas is diverted directly from the exhaust manifold by an EGR valve. However, the particulate matter in the recirculated exhaust gas can adversely affect the performance and durability of the internal combustion engine. As disclosed in U.S. Pat. No. 6,526,753 (the '753 patent), issued to Bailey on Mar. 3, 2003, a filter can be used to remove particulate matter from the exhaust gas that is being fed back to the intake air stream for recirculation. Specifically, the '753 patent discloses an exhaust gas regenerator/particulate capture system that includes a first particulate trap and a second particulate trap. A regenerator valve operates between a first position where an EGR inlet port fluidly connects a portion of an exhaust flow with the first particulate trap and a second position where the EGR inlet port fluidly connects the portion of the exhaust flow with the second particulate trap. The filtered EGR gases are then supplied for mixing with compressed air prior to or during entry into the intake manifold.

Although the exhaust gas regenerator/particulate capture system of the '753 patent may reduce the engine air pollutants exhausted to the environment while protecting the engine from harmful particulate matter, the exhaust gas regenerator/particulate capture system may be expensive and difficult to package. For example, because the exhaust gas regenerator/particulate capture system of the '753 patent must draw exhaust downstream of the first and second particulate traps and provide the recirculated exhaust flow to the intake manifold upstream of the engine, it may be large and awkward with extensive lengths of piping. This size coupled with the space required within the engine compartment to accommodate the exhaust gas regenerator/particulate capture system increases the cost of the exhaust gas regenerator/particulate capture system and the difficulty of retrofitting the exhaust gas regenerator/particulate capture system to older vehicles. In addition, the extensive lengths of piping and large particulate filters may create problematic flow restrictions.

The disclosed exhaust gas recirculation system is directed to overcoming one or more of the problems set forth above.

SUMMARY OF THE INVENTION

In one aspect, the present disclosure is directed to an exhaust gas recirculation system for a power source that includes at least one inlet port configured to receive at least a portion of a flow of exhaust produced by the power source. The exhaust gas recirculation system also includes an electrode disposed upstream of the at least one inlet port and configured to charge particulate matter in the flow of exhaust. The exhaust gas recirculation system further includes at least one collection surface configured to repel the charged particulate matter away from the at least one inlet port towards the at least one collection surface.

In another aspect, the present disclosure is directed to a method of operating an exhaust gas recirculation system. The method includes charging particulates entrained within an exhaust flow produced by the power source with at least one electrode. The method also includes receiving at least a portion of the exhaust flow with at least one inlet port and repelling the charged particulates away from the at least one inlet port towards at least one collection surface. The method further includes directing the at least a portion of an exhaust flow to an air induction system of the power source.

DETAILED DESCRIPTION

Figure 1:
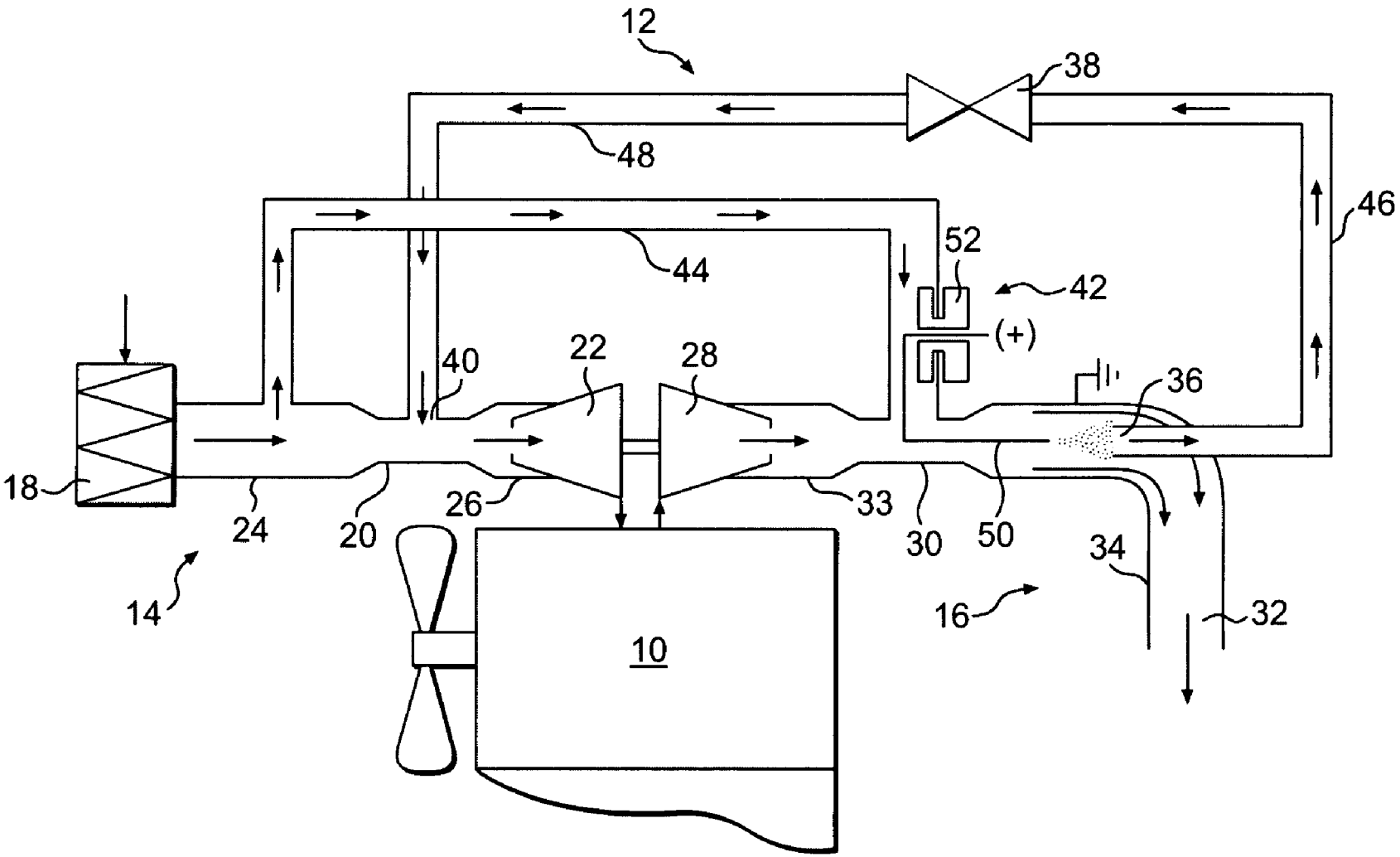
FIG. 1 is a diagrammatic illustration of an engine having an exhaust gas recirculation system according to an exemplary disclosed embodiment.

FIG. 1 illustrates a power source 10 having an exemplary exhaust gas recirculation (EGR) system 12. Power source 10 may include an engine such as, for example, a diesel engine, a gasoline engine, a natural gas engine, or any other engine apparent to one skilled in the art. Power source 10 may also include other sources of power, such as a furnace or any other source of power known in the art. Power source 10 may include an air induction system 14 and an exhaust system 16.

Air induction system 14 may be configured to introduce compressed air into a combustion chamber (not shown) of power source 10. Air induction system 14 may include an air filter 18, a venturi 20, and a compressor 22.

Air filter 18 may be configured to remove or trap debris from air flowing into power source 10. Air filter 18 may include any type of air filter such as, for example, a full-flow filter, a self-cleaning filter, a centrifuge filter, an electrostatic precipitator, or any other air filter known in the art. It is contemplated that more than one air filter 18 may be included within air induction system 14 and disposed in series or parallel relation.

Venturi 20 may be configured to constrict the flow of air within air induction system 14, thereby increasing a speed of the fluid passing through venturi 20 and, in turn, reducing a pressure of the flow of air through the constriction. Venturi 20 may be fluidly connected to air filter 18 via fluid passageway 24. It is contemplated that additional venturis may be included within air induction system 14. It is also contemplated that venturi 20 may be omitted, if desired, and a throttle valve (not shown) implemented instead.

Compressor 22 may be configured to compress the air flowing into power source 10 to a predetermined pressure when compressor 22 operates. Compressor 22 may be fluidly connected to venturi 20 via fluid passageway 26. Compressor 22 may include a fixed geometry type compressor, a variable geometry type compressor, or any other type of compressor known in the art. It is contemplated that more than one compressor 22 may be included and disposed in parallel or in series relationship. It is further contemplated that compressor 22 may be omitted, for example, when a non-compressed air induction system is desired.

Exhaust system 16 may be configured to direct exhaust flow out of power source 10. Exhaust system 16 may include a turbine 28, a venturi 30, and an exhaust outlet 32. It is contemplated that additional emission controlling devices may be included within exhaust system 16 such as, for example, particulate filters, catalysts, and other emission controlling devices known in the art.

Turbine 28 may be connected to compressor 22 and configured to drive compressor 22. In particular, as the hot exhaust gases exiting power source 10 expand against the blades (not shown) of turbine 28, turbine 28 may be caused to rotate, thereby rotating connected compressor 22. It is contemplated that more than one turbine 28 may be included within exhaust system 16 and disposed in parallel or in series relationship. It is also contemplated that turbine 28 may alternately be omitted and compressor 22 driven by power source 10 mechanically, hydraulically, electrically, or in any other manner known in the art.

Venturi 30 may be configured to constrict the exhaust flowing out of power source 10, thereby causing the pressure of the exhaust flow to drop within venturi 30. Venturi 30 may be connected to turbine 28 via fluid passageway 33. It is contemplated that more than one venturi may be included within exhaust system 16.

Exhaust outlet 32 may be connected to venturi 30 via fluid passageway 34 and configured to direct the exhaust flow from power source 10 to the atmosphere. Fluid passageway 34 may be electrically grounded. It is contemplated that additional or different surfaces within exhaust system 16 may be electrically grounded.

EGR system 12 may be configured to redirect a portion of the exhaust flow of power source 10 from exhaust system 16 into air induction system 14. EGR system 12 may include an inlet port 36, an EGR valve 38, a discharge port 40, an electrostatic precipitator device 42, and a shield gas passageway way 44. It is contemplated that EGR system 12 may include additional components such as, for example, an EGR gas cooler, additional valve mechanisms, valve driving mechanisms, a control system, an oxidation catalyst, and other EGR components known in the art.

Inlet port 36 may be connected to exhaust system 16 and configured to receive at least a portion of the exhaust flow from power source 10. Specifically, inlet port 36 may be disposed between venturi 30 and exhaust outlet 32 downstream from turbine 28. Inlet port 36 may be insulated from grounded portions of EGR system 12 and Exhaust system 16. It is contemplated that inlet port 36 may be located elsewhere within exhaust system 16.

EGR valve 38 may be fluidly connected to inlet port 36 via fluid passageway 46 and configured to regulate the flow of the fluid through inlet port 36. EGR valve 38 may be a spool valve, a shutter valve, a butterfly valve, a check valve, a diaphragm valve, a gate valve, a shuttle valve, a ball valve, a globe valve, or any other valve known in the art. EGR valve 38 may be electrically actuated, hydraulically actuated, pneumatically actuated, or actuated in any other manner. EGR valve 38 may be in communication with a controller (not shown) and selectively actuated in response to one or more predetermined conditions.

Discharge port 40 may be fluidly connected to EGR valve 38 via fluid passageway 48 and configured to direct the exhaust flow regulated by EGR valve 38 into air induction system 14. Specifically, discharge port 40 may be connected to venturi 20, wherein the low pressure of the air flowing through venturi 20 draws the exhaust flow from discharge port 40.

Electrostatic precipitator device 42 may include an electrically insulated electrode 50 configured to charge particulate matter entrained within the exhaust flow produced by power source 10 before the particulates reach inlet port 36. Electrode 50 may extend from shield gas passageway 44 into fluid passageway 34 to substantially co-axially align with inlet port 36. It is contemplated that electrode 50 may extend a portion of a distance into inlet port 36. Electrode 50 may be selectively connected to a high-voltage source (not shown) to create an ionizing atmosphere around electrode 50, as voltage is applied to electrode 50. The voltage applied to electrode 50 may range from 5,000 volts to 30,000 volts or higher, with a preferred range of 7,500 volts to 20,000 volts. It is contemplated that more than one electrode 50 may be associated with electrostatic precipitator device 42 and that electrode 50 may alternately be connected to a fluid passageway of exhaust system 16, rather than shield gas passageway 44. It is further contemplated that the voltage applied to electrode 50 may be higher than 20,000 volts without causing spark-over. It is further contemplated that the voltage applied to electrode 50 may be varied in response to one or more inputs such as, for example, engine speed, engine load, temperature, pressure, or any other engine operating condition.

Electrode 50 may be electrically insulated from shield gas passageway 44 via insulating means 52. Insulating means 52 may be any means for electrically insulating electrode 50 from shield gas passageway 44 such as, for example, a sleeve positioned between electrode 50 and the walls of shield gas passageway 44 made from an electrically non-conductive material such as, for example, a ceramic, a high-temperature plastic, a fibrous composite, or any other means known in the art. Insulating means 52 may be connected to a wall of shield gas passageway 44.

Shield gas passageway 44 may be configured to supply inlet air past electrode 50 and insulating means 52. The flow of air minimizes the amount of particulate matter that travels upstream within shield gas passageway 44 and deposits on electrode 50 and insulating means 52. Particulate matter buildup on either of electrode 50 and insulating means 52 may lead to arcing and fouling within electrostatic precipitator device 42. Shield gas passageway 44 may extend from fluid passageway 24 between venturi 20 and air filter 18 to venturi 30 of exhaust system 16. The low pressure within exhaust system 16 caused by venturi 30 may draw the non-compressed air into exhaust system 16. It is contemplated that shield gas passageway 44 may alternately be connected downstream of compressor 22, within air induction system 14, to provide a pressurized source of shield gas to prevent arcing or fouling of electrostatic precipitator device 42. It is also contemplated that a source of pressurized air other than compressor 22 may be included within EGR system 12.

INDUSTRIAL APPLICABILITY

The disclosed EGR system may be applicable to any combustion-type device such as, for example, an engine, a furnace, or any other device known in the art where the recirculation of substantially particulate-free exhaust gas into an air induction system is desired. EGR system 12 may be a simple, inexpensive, and compact solution to reducing the amount of exhaust emissions discharged to the environment while protecting the combustion-type device from harmful particulate matter and poor performance caused by particulate matter. The operation of EGR system 12 will now be explained in detail.

Atmospheric air may be drawn into air induction system 14 via air filter 18 and directed through fluid passageway 24, venturi 20, and fluid passageway 26 to compressor 22 where it is pressurized to a predetermined level before entering the combustion chamber of power source 10. Fuel may be mixed with the air prior to or after entering the combustion chamber. This fuel-air mixture may then be combusted by power source 10, thereby producing mechanical work and an exhaust flow containing gaseous compounds and solid particulate matter. The discharge of exhaust from the combustion chamber coupled together with the expansion of the hot exhaust gasses may cause turbine 28 to rotate and drive compressor 22.

After exiting turbine 28, the exhaust gases may be directed through fluid passageway 33 and venturi 30 and past electrode 50 of electrostatic precipitator device 42. As the exhaust flows from power source 10, voltage may be applied to electrode 50 causing electrode 50 to emit electrons thereby creating an ionizing field. This ionizing field may charge particulate matter that is entrained within the exhaust flow as the particulate matter enters the ionizing field. In order to minimize the particulate matter entrained within the exhaust flow from adhering to electrode 50 and causing arcing or fouling, air may be drawn from shield gas passageway 44 past electrode 50 and insulating means 52 by the low pressure exhaust flow created by venturi 30.

Simultaneous to charging the particulate matter, the walls of fluid passageway 34 may be electrically grounded, thereby allowing the ionizing field to electrostatically repel the charged particulate matter towards the grounded walls of fluid passageway 34. This electrostatic repelling action may cause the charged particulate matter to migrate away from inlet port 36 toward the grounded walls of fluid passageway 34. This repelling action may provide a zone of substantially particulate-free exhaust gas immediately upstream of inlet port 36, thereby decreasing the amount of particulate matter entrained within the portion of the exhaust flow received by inlet port 36.

The flow of the substantially particulate-free portion of the exhaust flow received by inlet port 36 may be regulated by EGR valve 38 and drawn back into air induction system 14 by the low pressure inlet air flow created by venturi 20. The recirculated exhaust flow may then be mixed with the air entering the combustion chamber. As described above, the exhaust gas, which is directed to the combustion chamber, reduces the concentration of oxygen therein, which in turn lowers the maximum combustion temperature within the cylinder. The lowered maximum combustion temperature slows the chemical reaction of the combustion process, thereby decreasing the formation of nitrous oxides. In this manner, the gaseous pollution produced by power source 10 may be reduced without experiencing the harmful effects and poor performance caused by particulate matter being introduced into power source 10 via EGR system 12.

Because the exhaust gas recirculated through air induction system 14 may be drawn from a point immediately downstream from turbine 28, the length of piping within EGR system 12 may be kept to a minimum, thereby decreasing flow restriction within EGR system 12. The short length of piping may allow for a compact system that is easily retrofitted to existing power systems. In addition, the compact size minimizes overall system cost.

It will be apparent to those skilled in the art that various modifications and variations can be made to the disclosed EGR system. Other embodiments will be apparent to those skilled in the art from consideration of the specification and practice of the disclosed EGR system. For example, rather than diverting exhaust gas from downstream of turbine 28 to upstream of compressor 22, the exhaust gas may be diverted from upstream of turbine 28 to a point downstream of compressor 22. It is also contemplated that EGR system 12 may function by using only naturally occurring charges within the particulate matter rather than applying a voltage to cause charging of the particulate matter. Further, electrostatic precipitator device 42 may divert solid particulate matter away from one or more exhaust system process components other than an EGR inlet port. These process components may include, for example, a turbine, a catalyst, a valve, or any other process components known in the art. It is further contemplated that electrostatic precipitator device 42 may be included in an air handling system that is not associated with an exhaust system, and used to divert charged particulates away from critical components of the air handling system. It is intended that the specification and examples be considered as exemplary only, with a true scope being indicated by the following claims and their equivalents.

What is claimed is:

1. A method of operating a gas handling system having one or more process components, comprising:

directing a flow of gas from an inlet towards the one or more process components;

charging particulates within the flow of gas with at least one electrode;

at least partially shielding the at least one electrode with shield gas; and diverting the charged particulates away from the one or more process components towards at least one collecting surface.

2. The method of claim 1, wherein at least partially shielding the at least one electrode includes directing a flow of the shield gas past the at least one electrode.

3. A method of operating an exhaust gas recirculation system for a power source, the method comprising:

charging particulates entrained within an exhaust flow produced by the power source with at least one electrode;

at least partially shielding the at least one electrode with a flow of shield gas;

receiving at least a portion of the exhaust flow with at least one inlet port;

repelling the charged particulates away from the at least inlet port towards at least one collection surface; and directing the at least a portion of the exhaust flow to an air induction system of the power source.

4. The method of claim 3, wherein repelling the charged particulates includes repelling the charged particulates away from the at least a portion of the exhaust flow upstream of the at least one inlet port.

5. The method of claim 3, wherein the air induction system includes at least one compressor and the at least a portion of the exhaust flow is directed to the air induction system upstream of the at least one compressor.

6. The method of claim 3, wherein the air induction system includes at least one venturi and the at least a portion of the exhaust flow is directed to the air induction system via the venturi.

7. The method of claim 3, further including regulating the flow of the at least a portion of the exhaust flow.

8. The method of claim 3, wherein the power source includes at least one turbine and the at least a portion of the exhaust flow is received downstream of the turbine.

9. The method of claim 3, further including electrically insulating the at least one electrode.

10. The method of claim 3, wherein the power source includes at least one venturi disposed in the exhaust flow, and the at least a portion of the exhaust flow is received via the venturi.

11. The method of claim 3, further including directing the flow of shield gas past the at least one electrode.

12. The method of claim 11, wherein the shield gas is directed from an air induction system of the power source.

13. The method of claim 12, wherein the power source includes at least one filter, and the shield gas is directed from downstream of the at least one filter.

14. A gas handling system, comprising:

an inlet;

an outlet in fluid communication with the inlet;

one or more process components disposed between the inlet and the outlet;

at least one electrode disposed between the inlet and the outlet, the at least one electrode configured to charge particulates in a flow gas between the inlet and the outlet;

a shield gas passageway configured to direct a flow of shield gas past the at least one electrode; and at least one collecting surface configured to collect the charged particulates.

15. The gas handling system of claim 14, wherein the at least one collecting surface includes grounded walls of a fluid passageway.

16. An exhaust gas recirculation system for a power source, comprising:

at least one inlet port configured to receive at least a portion of a flow of exhaust produced by the power source;

an electrode disposed upstream of the at least one inlet port and configured to charge particulate matter in the flow of exhaust, the electrode being at least partially shielded by a flow of shield gas; and at least one collection surface configured to allow the electrode to repel the charged particulate matter away from the at least one inlet port toward the at least one collection surface.

17. The exhaust gas recirculation system of claim 16, wherein the power source includes at least one turbine, the at least one inlet port being configured to receive the at least a portion of the flow of exhaust downstream from the at least one turbine.

18. The exhaust gas recirculation system of claim 16, wherein the power source includes an air induction system and the exhaust gas recirculation system further includes at least one discharge port in fluid communication with the at least one inlet port, the at least one discharge port configured to direct the at least a portion of the flow of exhaust into the air induction system.

19. The exhaust gas recirculation system of claim 18, wherein the air induction system includes at least one compressor and the at least one discharge port is fluidly connected to the air induction system upstream of the at least one compressor.

20. The exhaust gas recirculation system of claim 18, wherein the air induction system includes at least one venturi and the at least one discharge port is fluidly connected to the at least one venturi.

21. The exhaust gas recirculation system of claim 18, further including a valve disposed between the at least one inlet port and the at least one discharge port, the valve configured to regulate the flow of the at least a portion of the flow of exhaust.

22. The exhaust gas recirculation system of claim 16, further including a means for electrically insulating the at least one electrode.

23. The exhaust gas recirculation system of claim 22, further including a fluid passageway configured to direct the flow of shield gas past at least one of the means for insulating and the at least one electrode.

24. The exhaust gas recirculation system of claim 23, wherein the power source includes at least one venturi through which the flow of exhaust is directed, and the fluid passageway is fluidly connected to the at least one venturi.

25. The exhaust gas recirculation system of claim 23, wherein the power source includes an air induction system having an air source and an auxiliary air source separate from the air induction system, the flow of shield gas being supplied by the auxiliary air source.

26. The exhaust gas recirculation system of claim 23, wherein the power source includes an air induction system and the fluid passageway is fluidly connected to the air induction system.

27. The exhaust gas recirculation system of claim 26, wherein the air induction system includes at least one air filter and the fluid passageway is configured to receive the flow of shield gas from the air induction system downstream of the at least one air filter.

28. A power system, comprising:

a power source having an air induction system, the power source operable to produce a flow of exhaust; and an exhaust gas recirculation system in fluid communication with the flow of exhaust, the exhaust gas recirculation system including:

at least one inlet port configured to receive at least a portion the flow of exhaust;

an electrode disposed upstream of the at least one inlet port and configured to charge particulate matter in the flow of exhaust;

a means for electrically insulating the at least one electrode;

at least one collection surface configured to allow the at least one electrode to repel the charged particulate matter away from the at least one inlet port;

at least one discharge port in fluid communication with the at least one inlet port, the at least one discharge port configured to direct the at least a portion of the flow of exhaust into the air induction system; and a fluid passageway configured to direct a flow of shield gas past at least one of the means for insulating and the at least one electrode.

29. The power system of claim 28, wherein the air induction system includes at least one compressor, and the at least one discharge port is fluidly connected to the air induction system upstream of the at least one compressor.

30. The power system of claim 28, wherein the air induction system includes at least one venturi, and the at least one discharge port is fluidly connected to the venturi.

31. The power system of claim 28, wherein the power source includes at least one turbine, and the at least one inlet port is configured to receive the at least a portion of the flow of exhaust downstream from the at least one turbine.

32. The power system of claim 28, further including a valve disposed between the at least one inlet port and the at least one discharge port, the valve configured to regulate the flow of the at least a portion of the flow of exhaust.

33. The power system of claim 28, wherein the air induction system includes at least one air filter, and the fluid passageway is configured to receive the flow of shield gas from the air induction system downstream of the at least one filter.

34. The power system of claim 28, wherein the power source includes at least one venturi through which the flow of exhaust is directed, wherein the fluid passageway is fluidly connected to the at least one venturi.

* * * * *